US006979207B2

(12) United States Patent
Wenger et al.

(10) Patent No.: US 6,979,207 B2
(45) Date of Patent: Dec. 27, 2005

(54) ELECTRICAL CONNECTOR

(75) Inventors: Jeffrey P. Wenger, Wauseon, OH (US); David M. Harman, Delta, OH (US)

(73) Assignee: E & J Demark, Inc., Wauseon, OH (US)

( * ) Notice: Subject to any disclaimer, the term of this patent is extended or adjusted under 35 U.S.C. 154(b) by 0 days.

(21) Appl. No.: 10/738,024

(22) Filed: Dec. 16, 2003

(65) Prior Publication Data

US 2004/0132356 A1 Jul. 8, 2004

Related U.S. Application Data

(60) Provisional application No. 60/434,493, filed on Dec. 18, 2002.

(51) Int. Cl.[7] ..... H01R 4/66
(52) U.S. Cl. ..... 439/100; 439/863; 174/7
(58) Field of Search ..... 439/92, 100, 863, 439/799, 800; 174/7, 78, 6; 242/68.3; 285/31

(56) References Cited

U.S. PATENT DOCUMENTS 2,107,835 A * 2/1938 Milo ..... 439/100
3,713,791 A * 1/1973 Oakes ..... 428/677
3,998,400 A * 12/1976 Gee et al. ..... 242/573.3
4,156,793 A * 5/1979 Carlson ..... 174/7
4,435,005 A * 3/1984 Berger et al. ..... 285/31
4,540,845 A * 9/1985 Frola ..... 174/7
5,122,068 A * 6/1992 Koss ..... 439/98
5,131,856 A * 7/1992 Auclair ..... 439/100
5,503,575 A 4/1996 Ciampini
5,864,093 A 1/1999 Hecock et al.
6,137,049 A 10/2000 Hecock
6,398,596 B1 * 6/2002 Malin ..... 439/800

OTHER PUBLICATIONS

E & J DeMark, Inc., *Copperhead Drive on Connectors* catalog, 1999, 4 pages, Wauseon, Ohio.

* cited by examiner

*Primary Examiner*—Hien Vu
(74) *Attorney, Agent, or Firm*—MacMillan, Sobanski & Todd, LLC.

(57) ABSTRACT

An electrical connector for connecting a ground wire and a ground rod. The electrical connector having a metal body including a top and a cylindrical side wall. The body having a first internal wall defining a ground rod cavity and a second internal wall defining a ground wire cavity being positioned adjacent to and in communication with the ground rod cavity.

6 Claims, 7 Drawing Sheets

ELECTRICAL CONNECTOR

RELATED APPLICATION

The present application is related to and claims the benefit of U.S. Provisional Application No. 60/434,493, filed on Dec. 18, 2002.

BACKGROUND OF THE INVENTION

The present invention is generally directed to an electrical connector. More specifically, the invention is directed to a ground wire to ground rod connector for use in electrical grounding.

Past electrical connectors have been complicated, large and constructed of inferior materials. Accordingly, there is a need for an electrical connector that is relatively easy to use, small and constructed of superior materials. The present invention satisfies this need.

SUMMARY OF THE INVENTION

The electrical connector or the present invention includes a metal body having a top and a generally cylindrical side wall. The body has a first internal wall defining a ground rod cavity and a second internal wall defining a ground wire cavity being positioned adjacent to and in communication with the ground rod cavity. The ground rod cavity is sized and adapted to receive a ground rod and the ground wire cavity is sized and adapted to receive a ground wire. The electrical connector provides for connection between the ground rod and the ground wire.

The primary object of the present invention is to provide an electrical connector that is easy to use, small and constructed of superior materials.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 2:
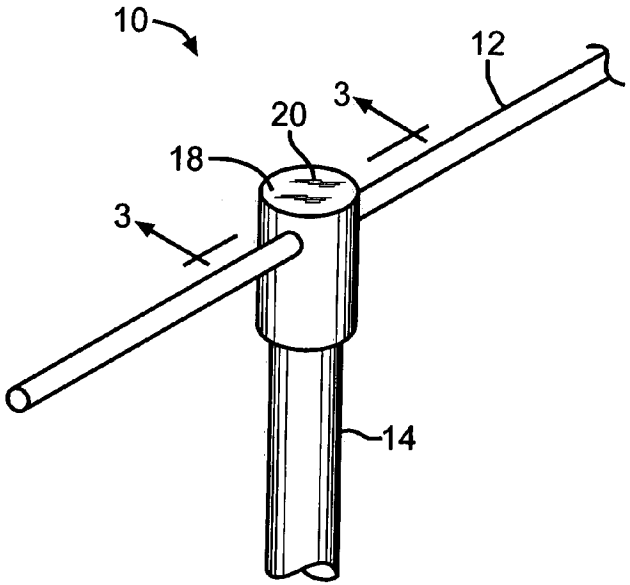
FIG. 2 is a view similar to the view of FIG. 1 in which the ground wire has been inserted in the electrical connector that has been positioned on the ground rod.

The preferred embodiments and best mode of the present invention will now be described in detail with reference being made to the drawings, which constitute a portion of the disclosure. In the drawings, the electrical connector of the present invention is generally indicated by the reference number "10".

Figure 1:
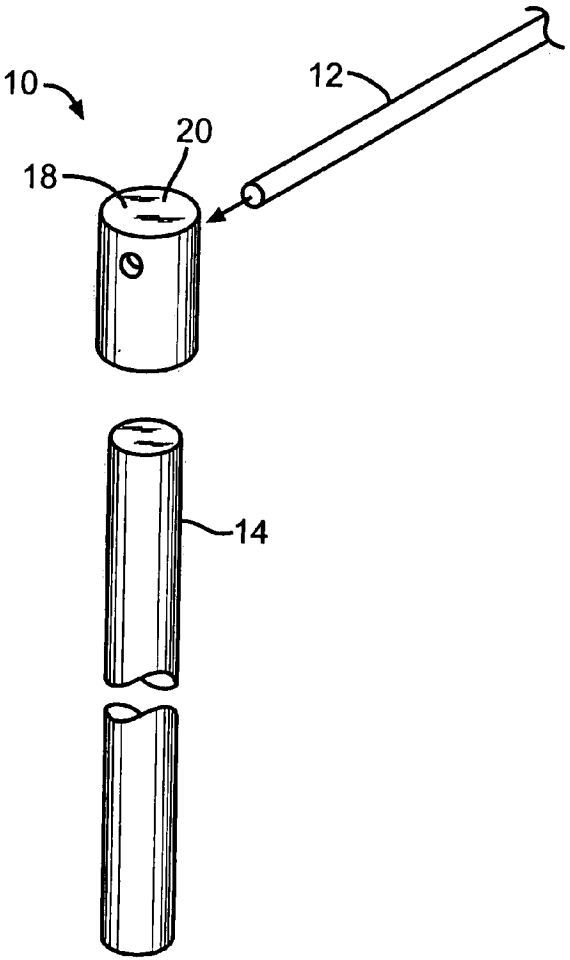
FIG. 1 is a perspective view showing a ground wire being positioned in an electrical connector according to the present invention adjacent to a ground rod.
Figure 5:
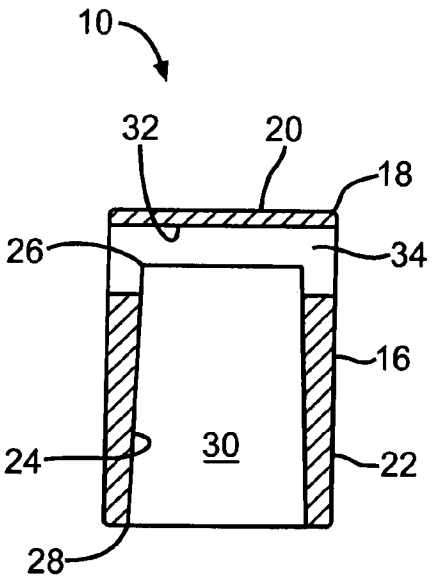
FIG. 5 is a cross-sectional view taken along line 5—5 of FIG. 4.
Figure 4:
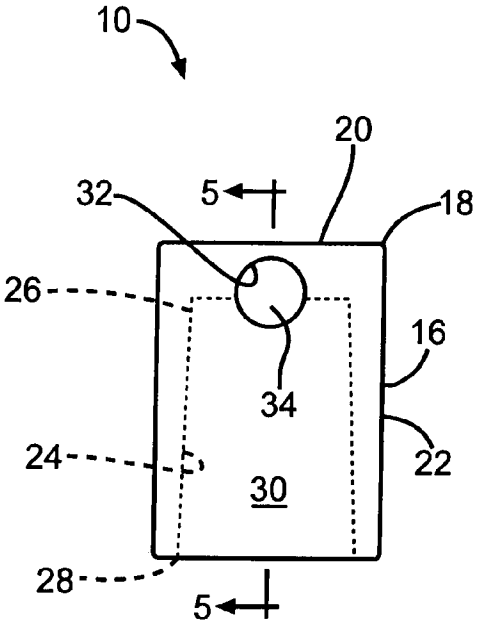
FIG. 4 is a side elevational view of the first embodiment electrical connector.
Figure 3:
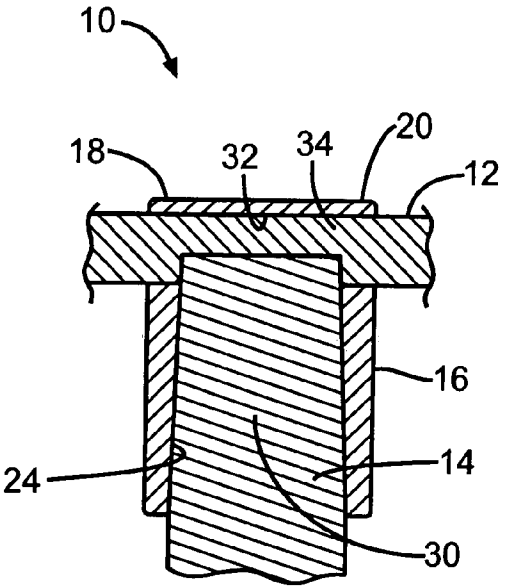
FIG. 3 is a cross-sectional view taken along line 3—3 of FIG. 2 showing a first embodiment electrical connector according to the present invention.

Referring to FIGS. 1–3, the electrical connector 10 is used to connect solid or stranded metal ground wire 12 to a metal ground rod 14. Referring to FIGS. 4 and 5, the electrical connector 10 includes a body 16 having a top 18 including a striking surface 20 and a cylindrical side wall 22 that depends downwardly from the top 18.

As shown in FIGS. 4 and 5, the body 16 includes a first internal wall 24 that has an upper end 26 and a lower end 28. The first internal wall 24 tapers from the lower end 28 to the upper end 26. The first internal wall 24 defines a ground rod cavity 30 that is sized and adapted to receive a ground rod 14 as shown in FIG. 3. It has been found that the tapered configuration of the first internal wall 24 allows for easy entry of the ground rod 14 in the lower end 28 and a snug fit at the upper end 26.

Referring to FIGS. 4 and 5, the body 16 includes a second internal wall 32 that defines a ground wire cavity 34 adjacent to the top 18. The ground wire cavity 34 is sized and adapted to receive a ground wire 12 as shown in FIG. 3. The ground rod cavity is transverse to the ground wire cavity 34.

In a preferred embodiment, the body 16 is comprised of a durable and malleable metal such as aluminum silicon bronze C64200 (silicon bronze). It has been found that silicon bronze is superior to other materials. It should be understood that other materials having similar properties can be used in the present invention.

Figure 7:
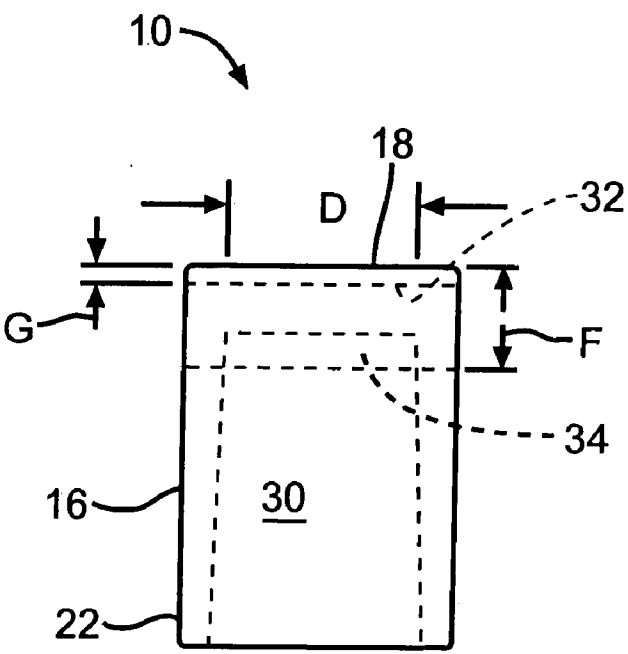
FIG. 7 is a side elevational view of the first embodiment electrical connector indicating dimensions.
Figure 6:
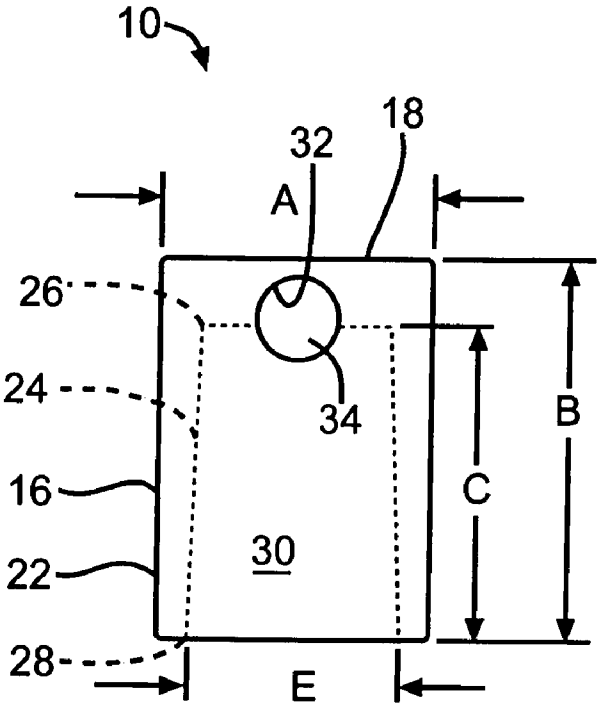
FIG. 6 is a side elevational view of the first embodiment electrical connector indicating dimensions.
Figure 10:
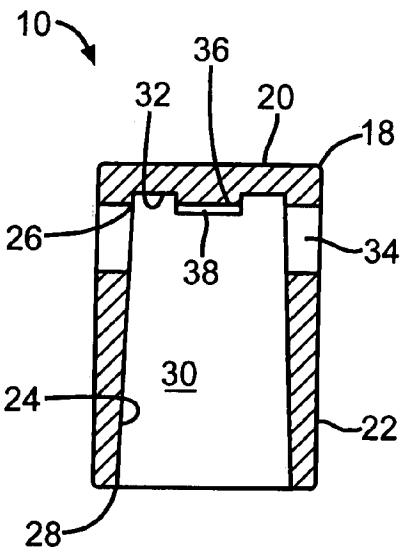
FIG. 10 is a cross-sectional view taken along line 10—10 of FIG. 9.
Figure 9:
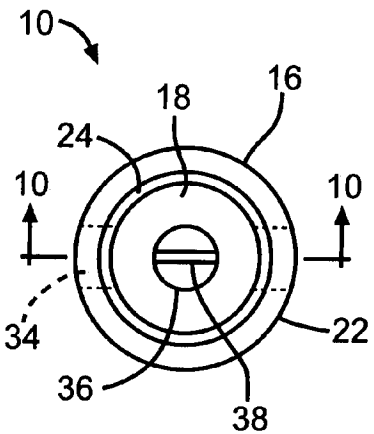
FIG. 9 is a bottom plan view of the second embodiment electrical connector.
Figure 8:
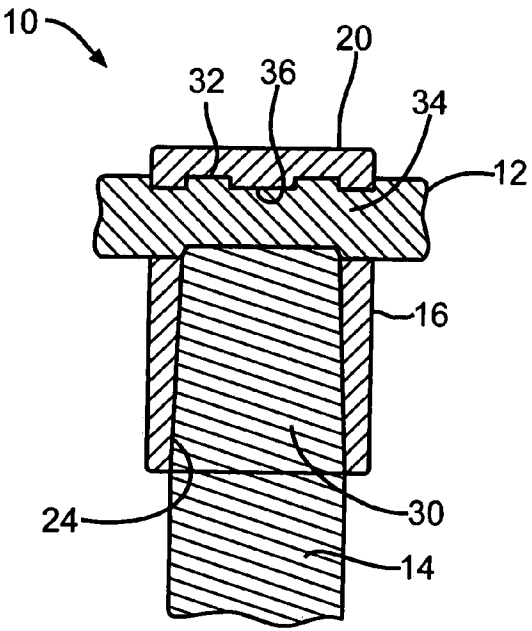
FIG. 8 is a cross-sectional view taken through the center of a second embodiment electrical connector according to the present invention.

Referring to FIGS. 6 and 7, the body 16 of a preferred embodiment has an O.D. A of 0.7500 inch and a length B of 1.0000 inch. The ground rod cavity 30, as defined by the first internal wall 24, has a length C of 0.8400 inch, a top dimension D of 0.5300 inch and a bottom dimension E of 0.5800 inch. The first internal wall 24 tapers from the lower end 28 to the upper end 26. In a preferred embodiment, the taper is 2° from center. As shown in FIG. 7, the ground wire cavity 34, as defined by the second internal wall 32, has an I.D. F of 0.2190 inch. The top 18 of the body 16 has a wall thickness dimension G of 0.0350 inch.

The wall thickness G of the top 18 is important to the function of the electrical connector 10. During use of the connector 10, as shown in FIGS. 1, 2 and 3, the striking surface 20 of the top 18 is struck by a tool such as a hammer to drive the ground rod 14 into the ground rod cavity 30 until it engages the ground wire 12. During this operation, it is important that the ground wire 12 stays straight when assembled even after excessive strikes. It has been found that the wall thickness G of the top 18 in combination with the silicon bronze of the body 16 allows the top 18 to be forgiving. This allows the ground wire 12 to stay tightly connected to the ground rod 14.

Still referring to FIGS. 6 and 7, in a preferred embodiment, the second internal wall 32 has an I.D. F that allows the ground wire cavity 34 to receive either #4 or #6 solid copper ground wire 12, as well as other wires having an O.D. of less than 0.2100 inch. The first internal wall 24 has dimensions C, D and E that allow the ground rod cavity 30 to accommodate a ⅝ inch galvanized ground rod 14.

A second embodiment electrical connector 10 is shown in FIGS. 8–12. The second embodiment electrical connector 10 includes the features of the first embodiment electrical connector 10 shown in FIGS. 1–7. Accordingly, the same reference numbers have been used in FIGS. 8–12. In the second embodiment electrical connector 10, the body 16 further includes a cylindrical stop 36 that extends downwardly from the top 18 into the ground wire cavity 34. The stop 36 includes a groove 38 that is positioned parallel to the ground wire cavity 34. The groove 38 is sized and adapted depending on the type of ground wire 12. In a preferred embodiment, the groove 38 has a depth of 0.0050 inch.

Figure 12:
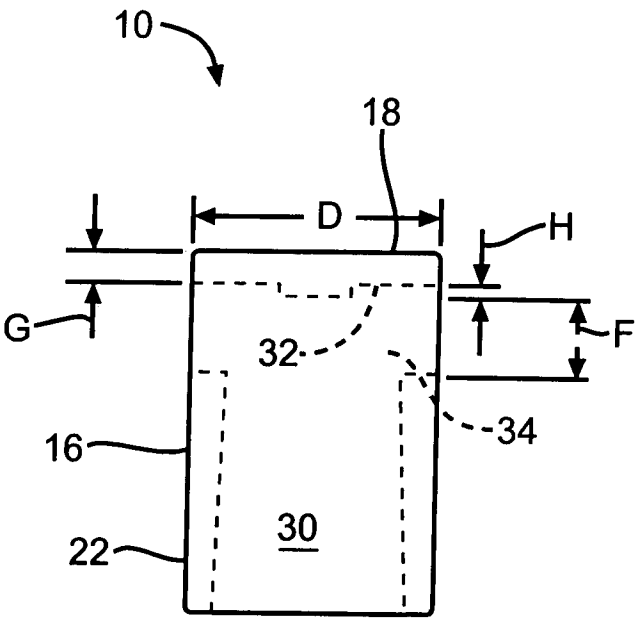
FIG. 12 is a side elevational view of the second embodiment electrical connector indicating dimensions.
Figure 11:
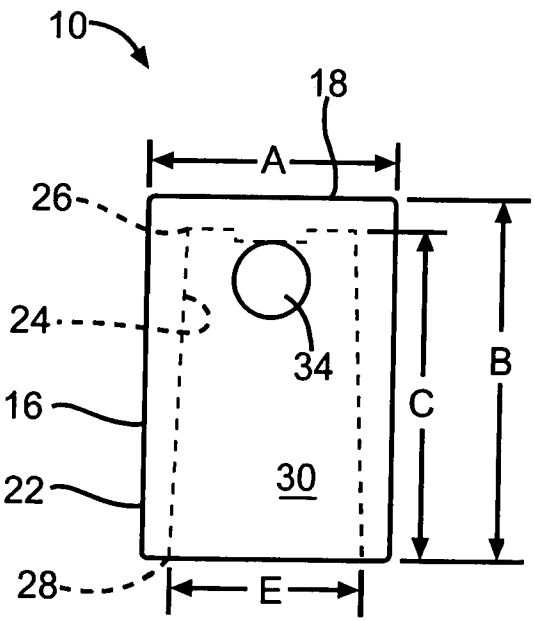
FIG. 11 is a side elevational view of the second embodiment electrical connector indicating dimensions.
Figure 15:
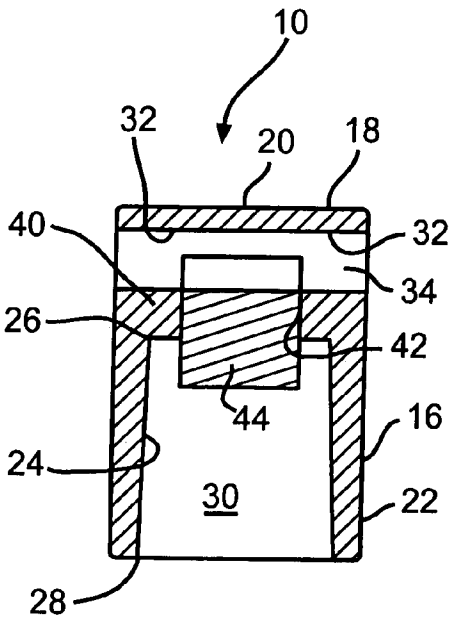
FIG. 15 is a cross-sectional view taken along line 15—15 of FIG. 14.
Figure 14:
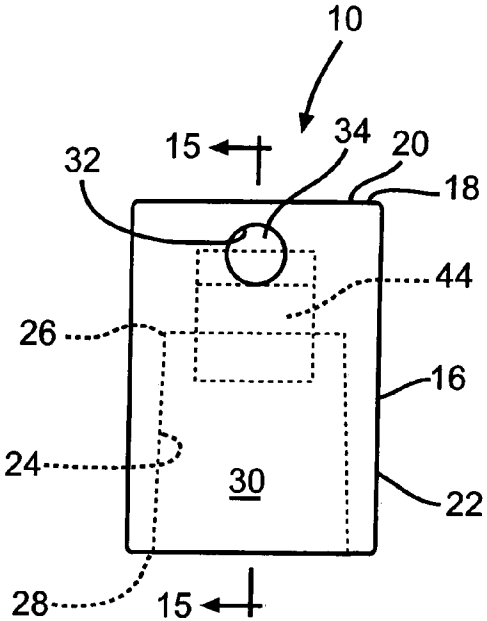
FIG. 14 is a side elevational view of the third embodiment electrical connector.
Figure 16:
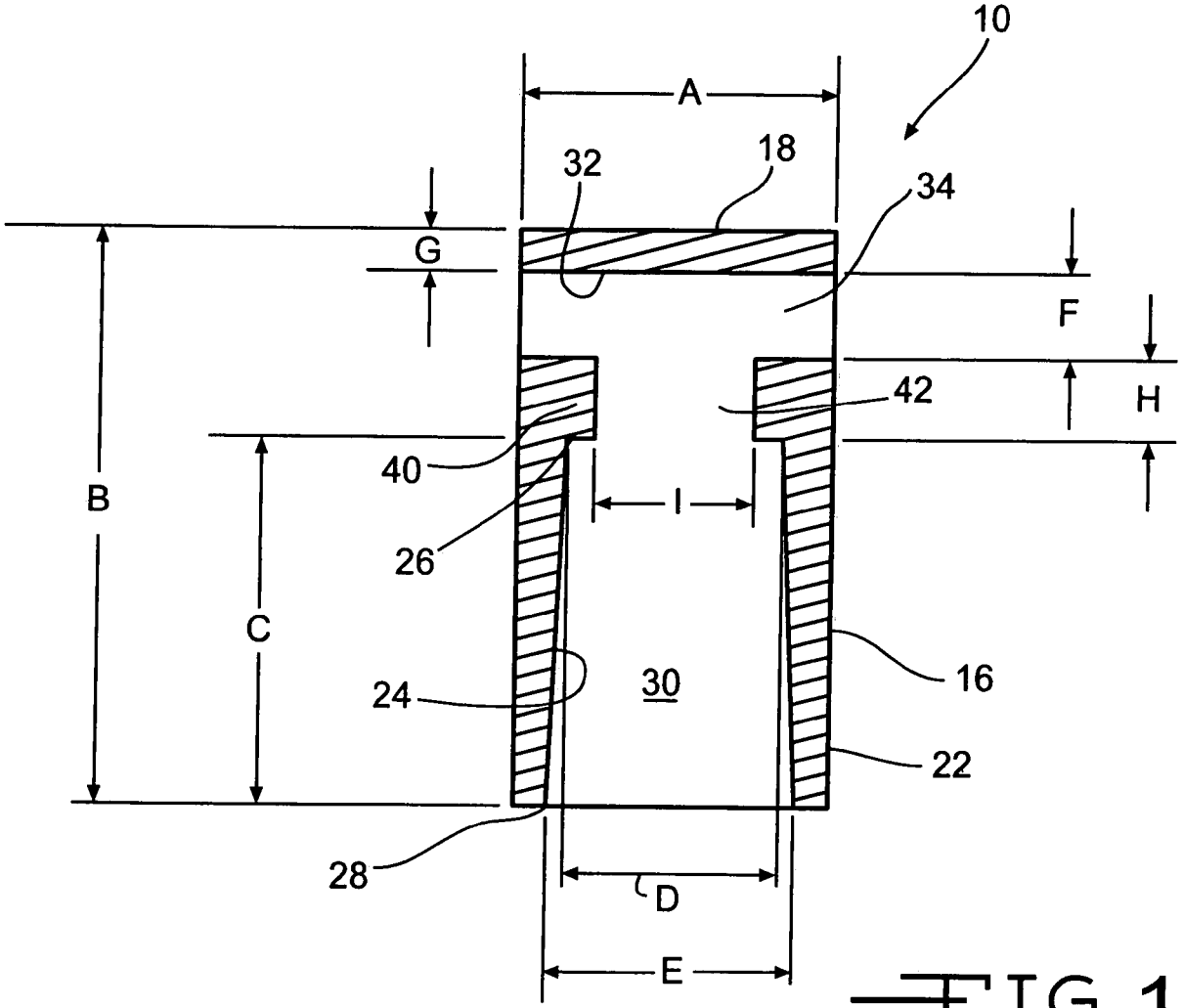
FIG. 16 is a cross-sectional view taken through the center of the third embodiment electrical connector indicating dimensions.

Referring to FIGS. 11 and 16, the body 16 of a preferred second embodiment has an O.D. A of 0.7500 inch and a length B of 1.1000 inch. The ground rod cavity 30, as defined by the first internal wall 24, has a length C of 1.0000 inch, a top dimension D of 0.5300 inch and a bottom dimension E of 0.6000 inch. The first internal wall 24 tapers from the lower end 28 to the upper end 26. In a preferred embodiment, the taper is 20 from center. As shown in FIG. 12, the ground wire cavity 34, as defined by the second internal wall 32, has an I.D. F of 0.2200 inch. The top 18 of the body 16 has a wall thickness dimension G of 0.1000 inch. The stop 36 extends from the second internal wall 32 at a dimension H of 0.0300 inch.

Figure 13:
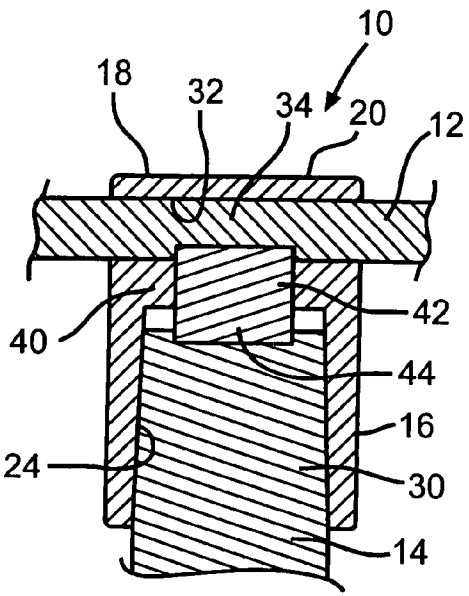
FIG. 13 is a cross-sectional view taken through the center of a third embodiment electrical connector according to the present invention.

A third embodiment electrical connector 10 is shown in FIGS. 13–16. The third embodiment electrical connector 10 includes the features of the first embodiment connector 10 shown in FIGS. 1–7. Therefore, the same reference numbers have been used in FIGS. 13–16. In the third embodiment electrical connector 10, the body 16 further includes a third internal wall 40 that defines a plug cavity 42. The third internal wall 40 extends between the ground rod cavity 30 and the ground wire cavity 34. A plug 44 is positioned in the plug cavity 42. During use, as shown in FIG. 13, the top of the ground rod 14 engages the plug 44 to move it upwardly into the ground wire cavity 34 until it engages the ground wire 12. This provides a connection between the ground rod 14 and the ground wire 12 through the plug 44.

Referring to FIG. 16, the body 16 of a preferred third embodiment electrical connector 10 has an O.D. A of 0.7500 inch and a length B of 1.3750 inch. The ground rod cavity 30, as defined by the first internal wall 24, has a length C of 0.8750 inch, a top dimension D of 0.5400 inch and a bottom dimension E of 0.5900 inch. As it will be appreciated, the ground rod cavity 30 tapers from the lower end 28 to the upper end 26. In a preferred embodiment, the taper is 20 from center. The ground wire cavity 34, is defined by the second internal wall 32, has an I.D. F of 0.2100 inch. The top 18 of the body 16 has a wall thickness dimension G of 0.1000 inch. The third interior wall 40 has a thickness dimension H of 0.1900 inch and the plug cavity 42 has a dimension I of 0.3750 inch.

It should be understood that all of the dimensions used herein for the electrical connector 10 can vary depending on the size and type of the ground wire 12 and the ground rod 14. The dimensions used herein provide an electrical connector 10 that is relatively small as compared to prior connectors.

The present invention allows a user to quickly and easily assemble an electrical connector 10 by inserting the ground wire 12 in the body 16 through the ground wire cavity 34, inserting a ground rod 14 in the ground rod cavity 30 and striking the striking surface 20 with a tool. The electrical connector 10 is relatively small as compared to prior connectors. Further, the silicon bronze material of the present invention provides a durable and malleable electrical connector 10.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. An electrical connector comprising a metal body having a top, an open bottom and a generally cylindrical side wall, said body having a first internal wall defining a ground rod cavity and a second internal wall defining a ground wire cavity being positioned adjacent to and in communication with said ground rod cavity, said body having a cylindrical stop extending downwardly from said top into said ground wire cavity, said stop having a groove positioned parallel to said ground wire cavity, said groove being sized and adapted for a ground wire positioned in said ground wire cavity, said first internal wall being tapered and extending from said open bottom of said metal body toward said top, said ground rod cavity at said bottom being larger than said ground rod cavity at said top.

2. The electrical connector of claim 1 wherein said metal of said body is bronze.

3. The electrical connector of claim 2 wherein said bronze is silicon bronze.

4. The electrical connector of claim 1 wherein said top includes a striking surface.

5. The electrical connector of claim 1 wherein said cylindrical side wall depends downwardly from said top.

6. The electrical connector of claim 1 wherein said ground wire cavity is transverse to said ground rod cavity.

* * * * *